United States Patent [19]

Gämmerler

[11] Patent Number: 4,696,464

[45] Date of Patent: Sep. 29, 1987

[54] METHOD OF AND AN APPARATUS FOR UNITING AT LEAST TWO STREAMS OF SHINGLED LAID OUT PRODUCTS, PARTICULARLY FOLDED PAPER PRODUCTS

[76] Inventor: Hagen Gämmerler, Ichoring 44, D-8021 Icking, Fed. Rep. of Germany

[21] Appl. No.: 823,307

[22] Filed: Jan. 28, 1986

[30] Foreign Application Priority Data

Jan. 29, 1985 [DE] Fed. Rep. of Germany ..... 3502896

[51] Int. Cl.[4] ..... B65H 29/66; B65G 47/26

[52] U.S. Cl. ..... 271/202; 271/9; 271/199; 270/51; 198/420

[58] Field of Search ..... 271/9, 202, 199, 270, 271/216, 10, 3; 270/56, 51; 198/420, 422

[56] References Cited

U.S. PATENT DOCUMENTS

| | | | |
|---|---|---|---|
| 3,816,866 | 6/1974 | Miaskoff et al. | 270/56 |
| 4,114,524 | 9/1978 | Welch | 198/420 X |
| 4,183,518 | 1/1980 | Brockmuller et al. | 271/202 X |
| 4,200,276 | 4/1980 | Marschke | 271/202 X |
| 4,214,743 | 7/1980 | Meier | 271/202 X |
| 4,313,600 | 2/1982 | Mosburger | 271/270 X |
| 4,585,227 | 4/1986 | Muller | 271/270 |

*Primary Examiner*—H. Grant Skaggs
*Assistant Examiner*—Gregory L. Huson
*Attorney, Agent, or Firm*—Paul L. Sjoquist

[57] ABSTRACT

A method of uniting at least two streams of shingled products, particularly folded paper products, in which the individual products of the two product streams and/or the united product stream are drawn apart on at least one partial section inter alia by means of a clock generator which consists of an endless belt rotating at an elevated speed and an intermittently operating pressing-on device synchronized with the conveying device.

3 Claims, 5 Drawing Figures

Figures 1, 2:
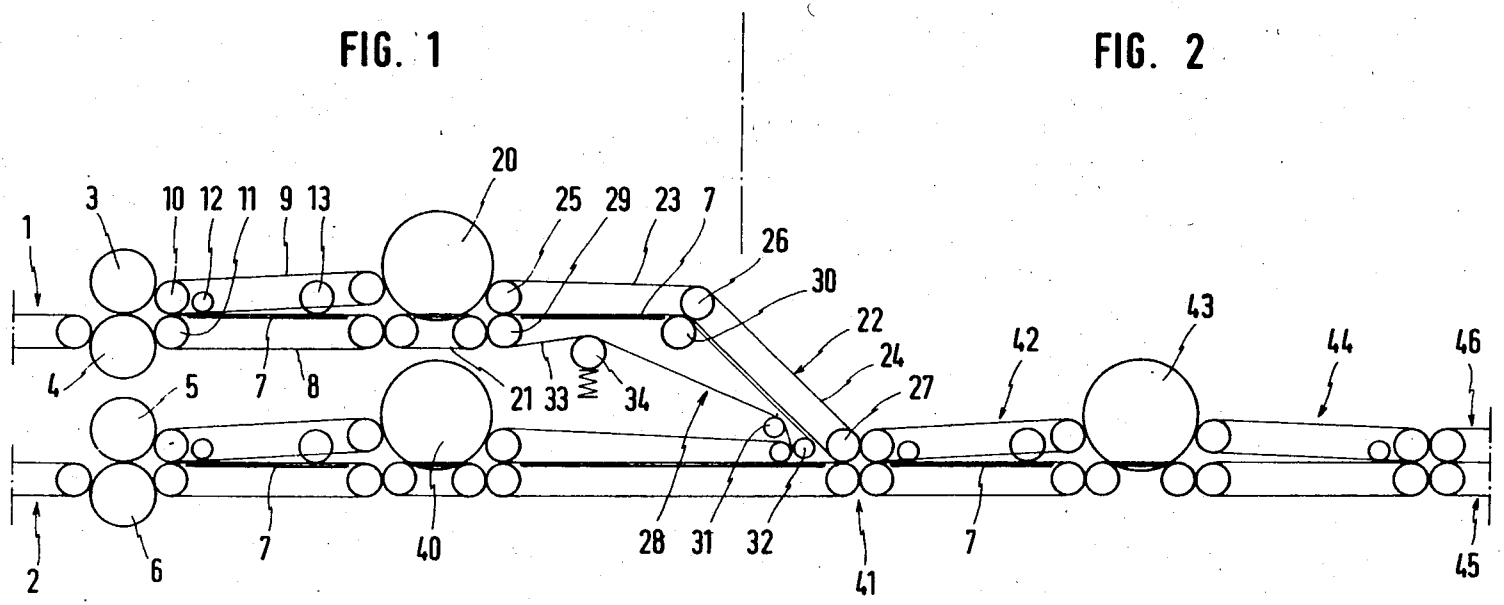

METHOD OF AND AN APPARATUS FOR UNITING AT LEAST TWO STREAMS OF SHINGLED LAID OUT PRODUCTS, PARTICULARLY FOLDED PAPER PRODUCTS

This invention relates mainly to a method of uniting at least two streams of products, particularly folded products, which are shingled laid out.

Printing machines, especially rotary wheel printing machines, deliver about 40,000 of already folded products which are to be subjected to further treatment, trimming or cutting. This is normally carried out by means of conveying means, i.e. for example conveying belts or continuous conveyors, where the individual products are usually supplied in shingled form which is attained by laying down the products leaving the printing machine via a so-called supply star; an shingled stream can also be formed through a feeding device, instead of using the supply star.

There is the possibility that a rotary wheel printing machine delivers two different product streams or that two printing machines which are mounted near to each other each deliver a product stream so that so far it has been necessary for each of the product streams to connect a separate processing system having respective treatment stations. Such systems extend possibly as far as over 30 to 50 meters and can also consist of individual modules.

This invention is based on the problem to simplify considerably the possibility of processing of at least two product streams.

This problem has been solved by the invention by drawing apart the individual products of the two product streams and/or the united product stream at least on one partial section.

It is possible in this way to reduce, after uniting of the product streams, the number of the processing steps or connected modules practically by half.

It is obvious that one can according to the above described method also easily unite three or four product streams before the necessary further treatment of the products is made.

According to a preferred modification of the inventive method, the product streams are united from different levels.

It has to be noted in this connection that in case of rotary wheel printing machines, there are sometimes also provided two product streams supplying stations, either one above the other or even one above the other while being offset from each other.

It is furthermore possible that the extension takes place after the products of the one stream have been put on top of the other one, or that this takes place after superposing of the two product streams of which single products are already placed on the conveying belt(s).

According to an especially preferred embodiment of the inventive method, the two product streams can be extended as far as to permit alternating of one product of the one product stream with one product of the other product stream so that all the products singly are on the conveying means. In this case, as well as in case of the above mentioned embodiments of the inventive method, one has self-evidently to operate at elevated speeds since the continuous delivery of the product streams has also to lead to a continuous processing. That is, there are conveyed e.g. 80,000 products/hour within the uniting region instead of the usual 40,000 products/hour.

Furthermore, the invention relates to an apparatus for carrying out the above described method, said apparatus being characterized mainly in that for extending the individual product streams or the united product stream there is provided at least one clock generator or timing originator including an endless belt rotating at elevated speed and an intermittently operating pressing-on device synchronized with the conveying speed.

Such a clock generator or timing originator has proved to be useful because it is avoided by the use thereof that the tolerances of the shingling, which can be up to 50% of the distance between the edges, remain unchanged and are not—as in former cases—doubled by the acceleration.

According to a preferred embodiment of the invention, there is arranged in advance of the clock generator a releasing device for enlarging the overlapping distance.

Whereas usually the clock generator with its endless belt has a rotational speed of twice the conveying speed of the delivered products, the pressing-on device for the endless belt is intermittently pressed onto the products such that this cycle is carried out synchronously with the initial conveying speed of the belt.

There is preferably provided at least one clock generator in each product stream and in the united product stream.

According to a modified embodiment of the invention, there is provided at least one continuous conveyor having an angular deviation which is constituted by two co-operating guide rollers or the like, and the lower belt is provided with a resiliently mounted tension roller or the like; a device for shingling can be arranged after the clock generator for the united product stream.

It has to be noted in this respect that in dependence on the subsequent treatment step, a cutting unit, shingling should be carried out to more or less a great extent although this with certainty is not necessary for all the treatment steps.

As already mentioned above, the rotational speed of the continuous conveyor of the clock generator can be at least twice as high as the conveying speed of the product streams and/or the united product stream. It is of course possible by the selection of the number of the pressing-on devices and by changing the rotational speed of a possible endless belt at the clock generator to cause either a faster or a slower run.

Figure 3:
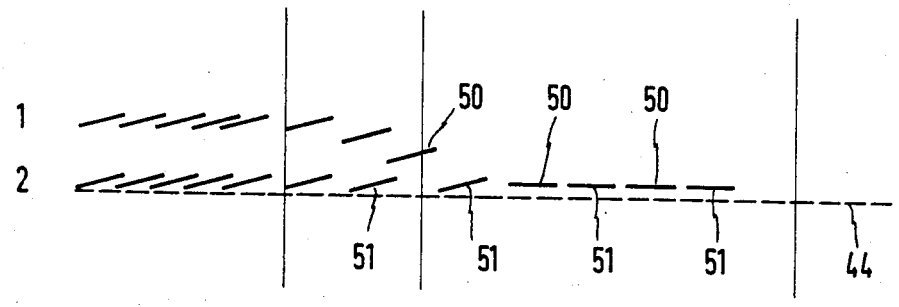
Figure 4:
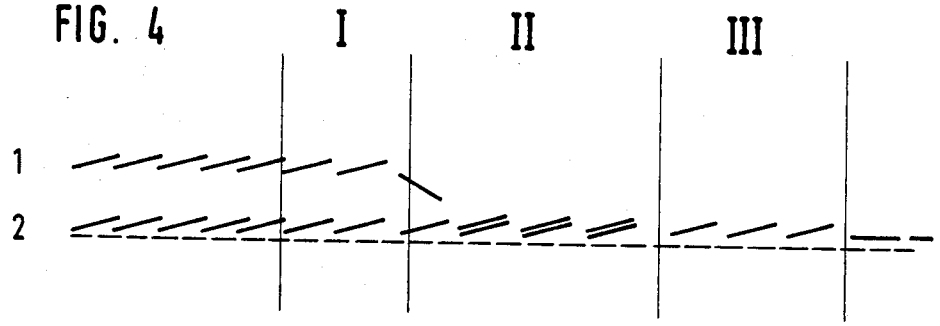
Figure 5:
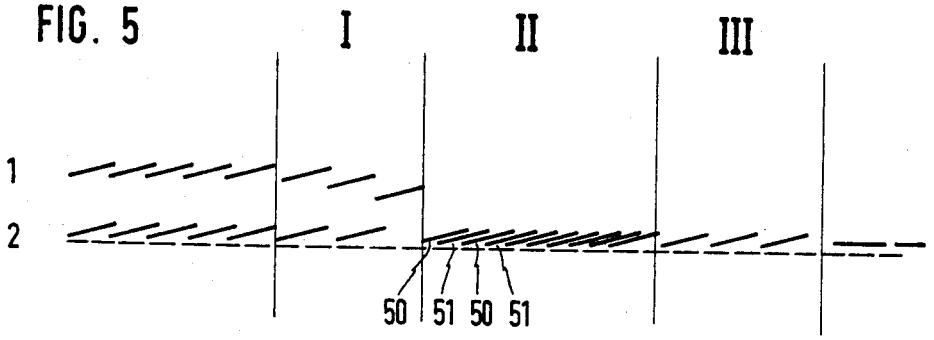

The drawing shows a schematized exemplifying embodiment of the invention; it is shown in FIGS. 1 and 2 a longitudinal section through an exemplifying embodiment of the invention, and FIGS. 3 to 5 each a scheme of uniting two product streams.

According to the exemplifying embodiment shown in FIGS. 1 and 2, there are supplied to pairs of presses 3,4 and 5,6 from a rotary wheel printing machine by means of commonly used continuous conveyors two product streams 1 and 2 which are placed one above the other at a space of about 25 to 30 cm. The product streams consist of products 7 each of which has a length of 30 cm and which are pressed together on the conveying plane between the presses 3 and 4 or 5 and 6. The products of each stream are shingled, and the distance from one product edge to the other product edge can be e.g. 8 cm; however, the two product streams 1 and 2 are attended with sources of error of up to ±4 cm in the distances between the lapping edges. Such errors result from the fact that the product stream is supplied in shingled form by the supply stars which are connected to the rotary wheel printing machine.

The two product streams can of course also come from two different printing machines or feeding devices, and they can also be arranged so as to be offset from each other but need not be placed—as shown—one directly above the other. In case of delivering of the product streams in one plane, it is first necessary to take care that the product streams are arranged each at a level differing from the level of the other one.

The individual products are introduced, after passing between the two pairs of presses 3,4 or 5,6, into a so-called releasing device having an overall length of about 40 cm. This releasing device consists of two superposed continuous conveyors 8,9 which between them form an acute angle of small width opening in conveying direction. In the vicinity of the rear guide roller pair 10,11 of the continuous conveyor 8,9, there is provided within the endless belt 9 an adjustable roller 12 which can be adapted to any desired length of the product.

The releasing device causes the respective product stream—there are supplied about 40,000 products per hour—to run at an accelerated speed which results in that the product stream is extended although shingling is still existing when the products leave the continuous conveyor 8,9 so that a subsequently arranged clock generator 20 provides for a further extension of the stream or the products to be singly placed. A free-running roller 13 causes, by gravity or spring force, an exact supply to the clock generator 20. The clock generator 20 includes a rotational conveyor (not shown) in the center of which is placed e.g. a star (not shown) which has e.g. (five equi-circumferential arms each having at its end spring-mounted free-running rollers which partially, i.e. above the continuous conveyor 21 provided as an abutment, come into contact with the individual products. The rotational belt can be run at two times to three times or several times the speed, while the star is rotated synchronously with e.g. five rotary rollers, with the supply star behind the rotary wheel printing machine.

In dependence on how the two product streams are to be put together, now the two streams are united either in shingled form or in fully extended form to the effect that the products of the one product stream are singly placed in the interspaces between the products of the other product stream, thus lying singly on the conveyors.

In case of the shown embodiment, the individual products of stream 1 are still in shingled form when they are supplied via a deviation conveyor 22 to the other product stream such that the products of the product stream 1 are laid down on the products of the product stream 2.

The deviation conveyor 22 consists of two endless deviation belts 23 and 24 each of which is guided around deviation rollers 25,26 and 26,27, respectively. The lower continuous conveyor 28 includes two deviation rollers 29 and 30 arranged in a horizontal plane and two smaller deviation rollers 31 and 32; the deviation belt 24 can be adjusted as to its effective length, this making possible a purposeful uniting of the producst streams.

The endless belt 33 can be kept under tension by a spring-mounted tension roller 34.

The product 7 of the product stream 1 is now—as has already been noted—guided downward in oblique direction and laid down on the product stream 2 which is also extended.

It is obvious that each the clock generator 20 and the clock generator 40 for the product stream 2 should be caused to operate synchronously so as to achieve—while neglecting the above mentioned error in distance between the edges—a purposeful placing of the products of the product stream 1 onto the product stream 2 (see statements hereinafter).

It is of course possible also to arrange two or three clock generators one after the other in case it is not possible to bring about in the respective product stream the required extension of the stream or drawing apart of the individual products of the respective product stream.

There is arranged after the uniting point 41 again a releasing device 42 which now extends the united product stream. Now there are delivered as many as 80,000 products per hour. The construction of said releasing device 42 is like that indicated in the foregoing.

There is arranged after said releasing device 42 a further clock generator 43 whose construction can correspond to that of the above mentioned clock generator 20. The clock generator 43 serves for drawing apart the individual products as far as to make possible imbricating thereof to the required extent so as to permit e.g. trimming or cutting.

The clock generator 43 arranged after the releasing device 42 thus causes again extension of the united product stream so as to permit now in the subsequently arranged shingling device 44 adjusting of the distance between the shingled edges to the effect that e.g. the cutting or trimming knives associated to the continuous conveyors 45,46 bring about reliably a smooth trimming.

In the above embodiment, the clock generators have a diameter of about 21 cm, the releasing device and the imbricating device each has a length of about 40 cm, and the deviation device has a length of 67 cm in conveying direction.

In case of the embodiment as shown in FIG. 3, one has proceeded from two product streams provided in shingled form and extended in section I by means of a releasing device and a clock generator to the effect that the individual products 50 of the product stream 1 each are put down in the gap formed in the extended product stream 2 between the products 51. The individual products in the now united product stream can in this form be supplied e.g. to a cutting unit; one can in advance thereof carry out the required shingling, as indicated by the reference numeral 44.

The acceleration to which the individual products of the two product streams are subjected to results from the necessity that the speed at which the products stream in has to correspond to the speed at which the united product stream streams out.

Since the individual products 50 or 51 from the shingled form have to be drawn apart from one another to a position in which they are each spaced from one another (including faults), one can reckon with having to accelerate the respective products by the releasing device and the clock generator by at least 2.5 times to about 3 times the former speed; then delaying of the united product stream prior to its entering the next following treatment step, i.e. a cutting unit, is performed correspondingly.

According to the embodiment shown in FIG. 4, the two product streams are similarly treated in section I although extension of the product stream 1 takes place to quite a less degree. In section II, then the two product streams are united by placing the product stream 1 on top of the product stream 2. Of course here are also supplied 80,000 products per hour, but since the overall length is much shorter, the acceleration in section I is much reduced.

In section III, now the united product stream is extended as far as to cause the individual products of the two product streams to lie alternately singly on the continuous conveyors. The following required shingling and corresponding delay of the speed can be performed in a way as already described, e.g. in advance of a cutting unit.

According to FIG. 5, the product streams are united in a modified way such that in section I the two product streams are extended to the effect that the distance between one product edge and the other product edge in the two product streams is adjusted to be about $\frac{2}{3}$ of the product length.

The product streams leaving section I thus are still in an shingled state. By synchronizing the clock generators in section I, now the product stream 1 is placed on top of the product stream 2 while being offset by $\frac{1}{3}$ of the product length. This shingling results in that always three products are placed one onto the other, when taking a cross-sectional view. Overlapping of three products consequently extends only over $\frac{1}{3}$ of the respective product length.

The superposed streams shingled such are now extended in section III by one or two releasing device(s) and one or two clock generator(s) such that again is produced—as in case of the exemplifying embodiment shown in FIG. 4—a single united product stream whose products are singly placed on the conveying belt. This stream can further be treated in the way as indicated above.

I claim:

1. A method of uniting at least two streams of shingled paper products and the like, comprising the steps of passing a first stream of shingled products along a moving conveyor; passing a second stream of shingled products along a second conveyor at a higher elevation than said first conveyor; synchronizing the movement of the first product stream with the movement of the second product stream; merging the second stream of shingled products with the first stream of shingled products by ejecting the second stream from the higher elevation second conveyor to the first conveyor; and separating the merged first and second streams into a non-shingled single product stream by drawing out the merged first and second streams.

2. The method of claim 1, wherein the step of merging further comprises alternately shingling said second stream products with said first stream products.

3. The method of claim 1, wherein the step of merging further comprises alternating drawing out the shingled second stream of shingled products and the shingled first stream of shingled products and then ejecting the second stream of products from the higher elevation second conveyor to alternate with the first stream products on the first conveyor.

* * * * *